US007743774B2

(12) United States Patent
Lane

(10) Patent No.: US 7,743,774 B2
(45) **Date of Patent: *Jun. 29, 2010**

(54) HAIR ACCESSORY

(75) Inventor: Teresa Lane, Kansas City, MO (US)

(73) Assignee: Celebrity Signatures International, Inc., Kansas City, MO (US)

( * ) Notice: Subject to any disclaimer, the term of this patent is extended or adjusted under 35 U.S.C. 154(b) by 618 days.

This patent is subject to a terminal disclaimer.

(21) Appl. No.: 11/524,587

(22) Filed: Sep. 21, 2006

(65) Prior Publication Data

US 2007/0012329 A1 Jan. 18, 2007

Related U.S. Application Data

(63) Continuation of application No. 10/861,434, filed on Jun. 4, 2004, now Pat. No. 7,278,432.

(51) Int. Cl.

| | |
|---|---|
| ***A45D 24/04*** | (2006.01) |
| ***A45D 8/00*** | (2006.01) |
| ***A45D 8/12*** | (2006.01) |
| ***A41G 3/00*** | (2006.01) |

(52) U.S. Cl. ..... 132/53; 132/273; 132/275; 132/128

(58) Field of Classification Search ..... 132/53, 132/54, 55, 56, 128, 201, 273, 105, 104, 132/275

See application file for complete search history.

(56) References Cited

U.S. PATENT DOCUMENTS

| | | | |
|---|---|---|---|
| 125,382 | A | 4/1872 | Cutter |
| 541,125 | A | 6/1895 | Simonson |
| 1,424,845 | A | 8/1922 | Nolan |
| 1,519,107 | A | 12/1924 | Breslauer |
| 1,540,102 | A | 6/1925 | Ross-Kuehn |
| 1,549,334 | A | 8/1925 | Ruffio |

(Continued)

FOREIGN PATENT DOCUMENTS

| | | |
|---|---|---|
| AU | 740896 | 12/1998 |

(Continued)

OTHER PUBLICATIONS

File history of related U.S. Appl. No. 11/670,319 as of Mar. 13, 2009.

*Primary Examiner*—Robyn Doan
(74) *Attorney, Agent, or Firm*—Lathrop & Gage LLP

(57) ABSTRACT

Hair accessories are provided that include first and second combs, a support member, and a plurality of hair strands coupled to the support member. In one embodiment, a connecting member connects the first and second combs and the support member is spirally wrapped around the connecting member. In another embodiment, a plurality of elastic strips connect the first and second combs, and the support member is coupled to at least one respective elastic strip. In yet another embodiment, an elastic unit connects the first and second combs, and the hair strands are operatively coupled to the elastic unit. The elastic unit includes a first base band operatively coupled to the first comb, a second base band operatively coupled to the second comb, and a plurality of elastic strips extending between the first base band and the second base band to connect the first base band and the second base band.

20 Claims, 9 Drawing Sheets

U.S. PATENT DOCUMENTS

| | | | | |
|---|---|---|---|---|
| 1,638,016 | A | 8/1927 | Oppenheim | |
| 1,665,380 | A * | 4/1928 | Ruffio | 132/105 |
| 1,780,766 | A | 11/1930 | Oppenheim | |
| 2,651,310 | A | 9/1953 | Selson | |
| 3,280,826 | A | 10/1966 | Jenkins | |
| 3,434,481 | A | 3/1969 | Mazzocco | |
| 3,485,249 | A | 12/1969 | Mast | |
| 3,520,310 | A | 7/1970 | Witmondt | |
| 3,561,457 | A | 2/1971 | Duesel | |
| 3,734,105 | A | 5/1973 | Borghese | |
| 3,777,768 | A | 12/1973 | Scigliano | |
| 3,834,403 | A | 9/1974 | Ahn | |
| 3,889,695 | A | 6/1975 | Incando | |
| 3,910,291 | A | 10/1975 | Kim | |
| 4,600,029 | A | 7/1986 | Ueberschaar | |
| D316,161 | S | 4/1991 | Kuglen | |
| 5,271,420 | A | 12/1993 | Park | |
| D356,398 | S | 3/1995 | Hafid | |
| 5,501,239 | A | 3/1996 | Walker | |
| 5,551,452 | A | 9/1996 | Barlow | |
| 5,690,128 | A | 11/1997 | Grimes | |
| 5,787,904 | A | 8/1998 | Michaud | |
| 5,806,535 | A | 9/1998 | Becker | |
| 5,813,418 | A | 9/1998 | Pillars | |
| 5,873,373 | A | 2/1999 | Narvick | |
| 5,899,211 | A | 5/1999 | Brown | |
| 5,937,867 | A | 8/1999 | Williams | |
| 5,947,129 | A | 9/1999 | Bradshaw | |
| 5,979,462 | A | 11/1999 | Jones | |
| 5,988,177 | A | 11/1999 | Bate | |
| 6,016,814 | A | 1/2000 | Elliott | |
| 6,019,107 | A | 2/2000 | Overmyer et al. | |
| 6,035,861 | A | 3/2000 | Copello | |
| 6,047,705 | A | 4/2000 | Hawley | |
| 6,082,371 | A | 7/2000 | Bader-Saltzman et al. | |
| 6,105,584 | A | 8/2000 | Williams | |
| 6,123,086 | A | 9/2000 | Kuglen | |
| 6,135,125 | A | 10/2000 | Sartena | |
| 6,206,011 | B1 | 3/2001 | Sartena | |
| 6,247,476 | B1 | 6/2001 | Sartena | |
| 6,257,250 | B1 | 7/2001 | Sartena | |
| 6,273,097 | B1 | 8/2001 | Sartena | |
| 6,298,861 | B1 | 10/2001 | Kageyama | |
| 6,302,115 | B1 | 10/2001 | Sartena | |
| 6,352,079 | B1 | 3/2002 | Bate | |
| 6,513,535 | B1 | 2/2003 | Lane | |
| 6,581,611 | B2 | 6/2003 | Sartena | |
| 6,629,536 | B1 | 10/2003 | Lane | |
| 6,691,717 | B2 * | 2/2004 | Silva | 132/275 |
| 6,708,696 | B2 | 3/2004 | Ferguson | |
| 6,766,805 | B1 | 7/2004 | Cupp | |
| 6,830,054 | B1 | 12/2004 | Ross-Kuehn | |
| D510,779 | S | 10/2005 | Gladwin et al. | |
| D511,022 | S | 10/2005 | Gladwin et al. | |
| 7,150,282 | B2 | 12/2006 | Lane | |
| 7,174,899 | B2 | 2/2007 | Lane | |
| 7,174,900 | B2 | 2/2007 | Lane | |
| 2003/0140934 | A1 | 7/2003 | Sugai | |
| 2004/0103909 | A1 | 6/2004 | Silva | |
| 2004/0237987 | A1 | 12/2004 | Gold | |
| 2005/0268928 | A1 | 12/2005 | Lane | |
| 2009/0277467 | A2 * | 11/2009 | Kuglen | 132/128 |

FOREIGN PATENT DOCUMENTS

| | | |
|---|---|---|
| AU | 2007246332 | 11/2007 |
| CA | 2265653 | 12/1998 |
| CA | 2643435 | 11/2007 |
| CN | 1234724 | 11/1999 |
| CN | 1450867 | 10/2003 |
| DE | 69834707 | 1/2007 |
| DK | 925731 | 7/2006 |
| EP | 0 929 242 B1 | 7/2002 |
| EP | 1275314 | 1/2003 |
| EP | 925731 | 5/2006 |
| ES | 2260836 | 11/2006 |
| GB | 1035195 | 7/1966 |
| JP | 11001811 | 1/1999 |
| TW | 491695 | 6/2002 |
| WO | 9854993 | 12/1998 |
| WO | 0164065 | 9/2001 |
| WO | 2007129708 | 11/2007 |

* cited by examiner

HAIR ACCESSORY

RELATED APPLICATIONS

The present application is a continuation of and claims benefit of priority to U.S. patent application Ser. No. 10/861,434, filed Jun. 4, 2004 now U.S. Pat. No. 7,278,432 and titled "Attachable/Detachable Supplemental Hair Accessory", which is incorporated herein by reference.

BACKGROUND

This invention relates generally to hair accessories and, more particularly, to hair accessories that supplement the natural hair of a user in an attachable and detachable manner.

A person may supplement their natural hair with hair pieces to allow a wider variety of hair styles to be obtained. Additionally, when the person has relatively thin hair, the person can supplement their natural hair to create the impression of a fuller head of hair. At least one known form of such a hair piece supplements the natural hair by attaching strands of hair to visible hair attachment devices. The hair attachment device is then used to hold the hair piece to the person's head. However, at least one known form of such an attachment device has been known to become detached during use, hanging from the person's natural hair or falling off completely. The person may wish to supplement their natural hair with a securely attachable, detachable, hair accessory, with the attachment device remaining substantially unseen.

SUMMARY

In one embodiment, a hair accessory is provided that includes a first comb, a second comb, a connecting member connecting the first comb and the second comb, a support member spirally wrapped around the connecting member, and a plurality of hair strands coupled to the support member.

In another embodiment, a hair accessory is provided that includes a first comb, a second comb, a plurality of elastic strips connecting the first comb and the second comb, a support member coupled to at least one respective elastic strip, and a plurality of hair strands coupled to the support member.

In yet another embodiment, a hair accessory is provided that includes a first comb, a second comb, and an elastic unit connecting the first comb and the second comb. The elastic unit includes a first base band operatively coupled to the first comb, a second base band operatively coupled to the second comb, and a plurality of elastic strips extending between the first base band and the second base band to connect the first base band and the second base band. A plurality of hair attachment member are coupled to the plurality of elastic strips, and a plurality of hair strands are coupled to the hair attachment members.

DETAILED DESCRIPTION

Figure 1:
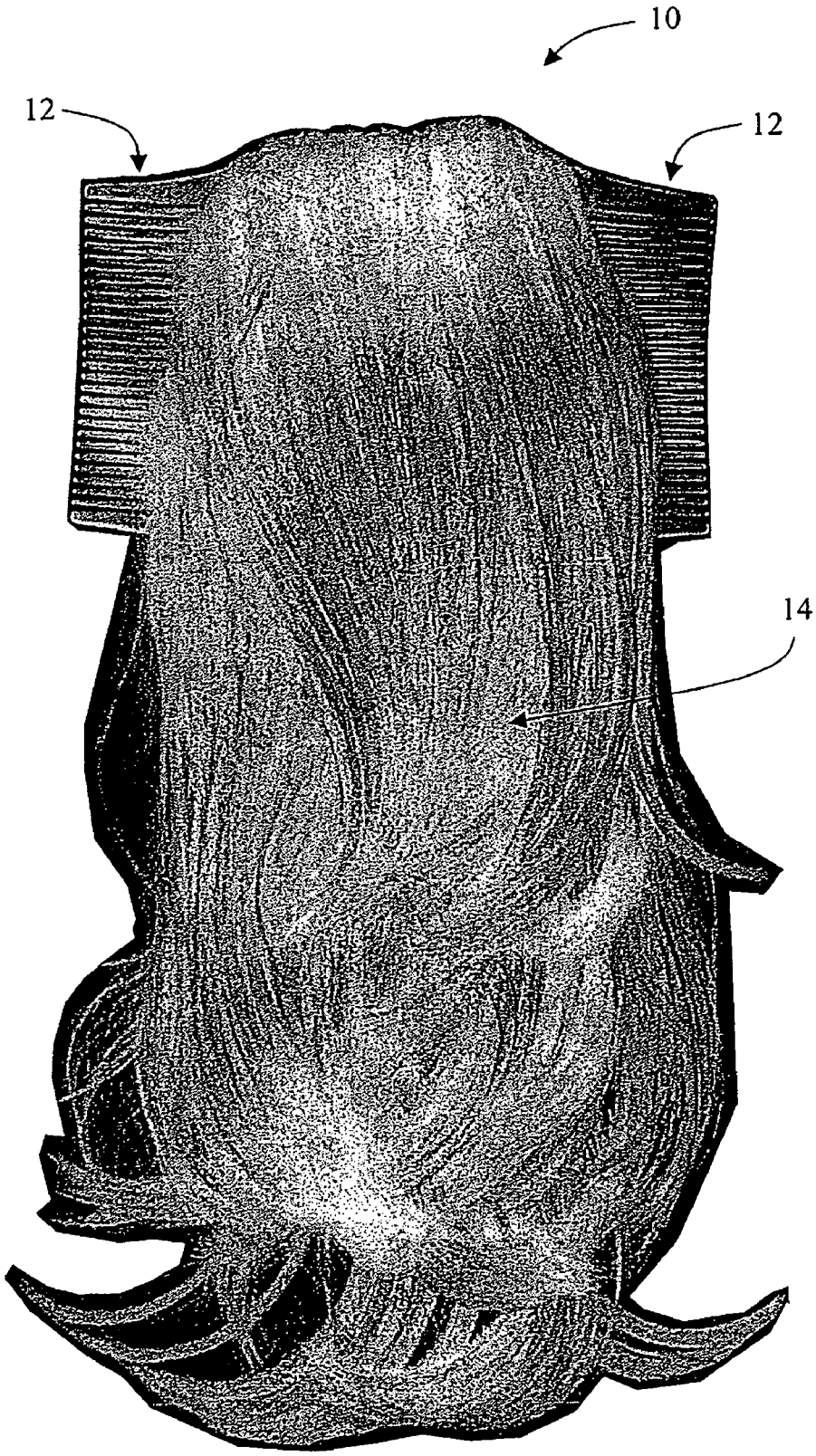
FIG. 1 shows an embodiment of a hair accessory.

FIG. 1 shows one embodiment of a hair accessory 10 including attachment devices connected together by a plurality of connecting members. More specifically, hair accessory 10 includes two combs 12 oriented substantially parallel to one another and connected together by a plurality of elastic members (not shown). Bundled strands of hair 14 extend from each elastic member. When combs 12 are oriented as shown in FIG. 1, the elastic members of hair accessory 10 are positioned substantially parallel to one another. The positioning of the individual elastic members of hair accessory 10 substantially parallel to one another creates a layered look for the hair utilized in hair accessory 10.

Figure 2:
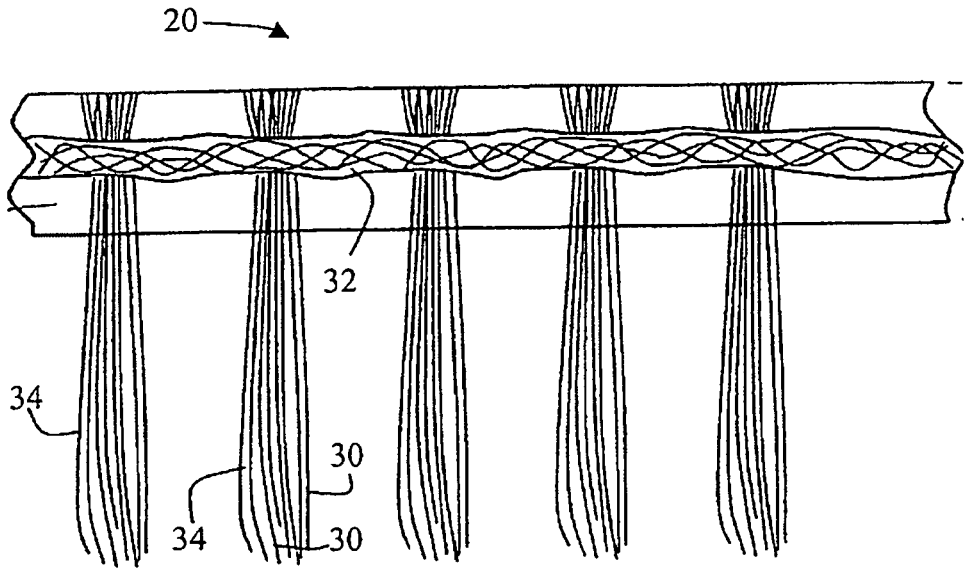
FIG. 2 is a side view of a portion of a support member utilized in fabricating the hair accessory shown in FIG. 1.

FIG. 2 is a side view of a portion of a support member 20 utilized in fabricating hair accessory 10. A plurality of hair strands 30 extend from support member 20. Hair strands 30 are, in one embodiment, sewn onto support member 20 and held in place by a plurality of threads 32. In an alternative embodiment, hair strands 30 are attached to support member 20 utilizing adhesive, pins, and/or clips. Alternatively, any other method of attachment of hair strands 30 to support member 20 may be utilized to attach hair strands 30 to support member 20.

In an exemplary embodiment, hair strands 30 are synthetic hair fabricated from a polymer fiber such as modacrylic. In another embodiment, hair strands 30 are synthetic hair fabricated from a polymer fiber other than modacrylic, such as, for example, acrylic. In an alternative embodiment, hair strands 30 are natural hair. In a further alternative embodiment, hair strands 30 include both synthetic hair and natural hair. In another embodiment, hair strands 30 are grouped into hair bundles 34.

Figure 3:
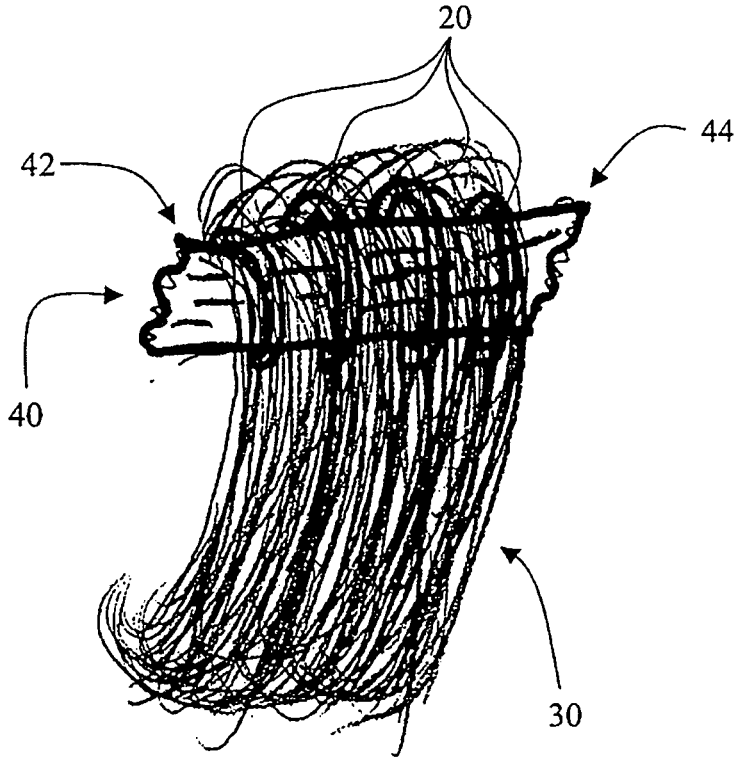
FIG. 3 shows a view of a portion of an elastic member spirally wrapped by the support member.

FIG. 3 is a view of a portion of an elastic member 40 where support member 20 is spirally wrapped around elastic member 40. Hair strands 30 are attached to elastic member 40 by wrapping support member 20 in a spiral fashion around elastic member 40. Elastic member 40 includes a first end 42, a second end 44, and a length extending between first end 42 and second end 44. The spiral wrapping allows hair strands 30 to lay at angles which provide the appearance of natural hair when worn with a user's natural hair. In one embodiment, support member 20 is slidably attached to elastic member 40. Alternatively, support member 20 is fixedly attached to elastic member 40. In a further embodiment, a portion of support member 20 is fixed to elastic member 40 thus allowing the slidable portions of support member 20 to move with respect to elastic member 40 while keeping a portion of support member 20 fixed with respect to elastic member 40.

Figure 4:
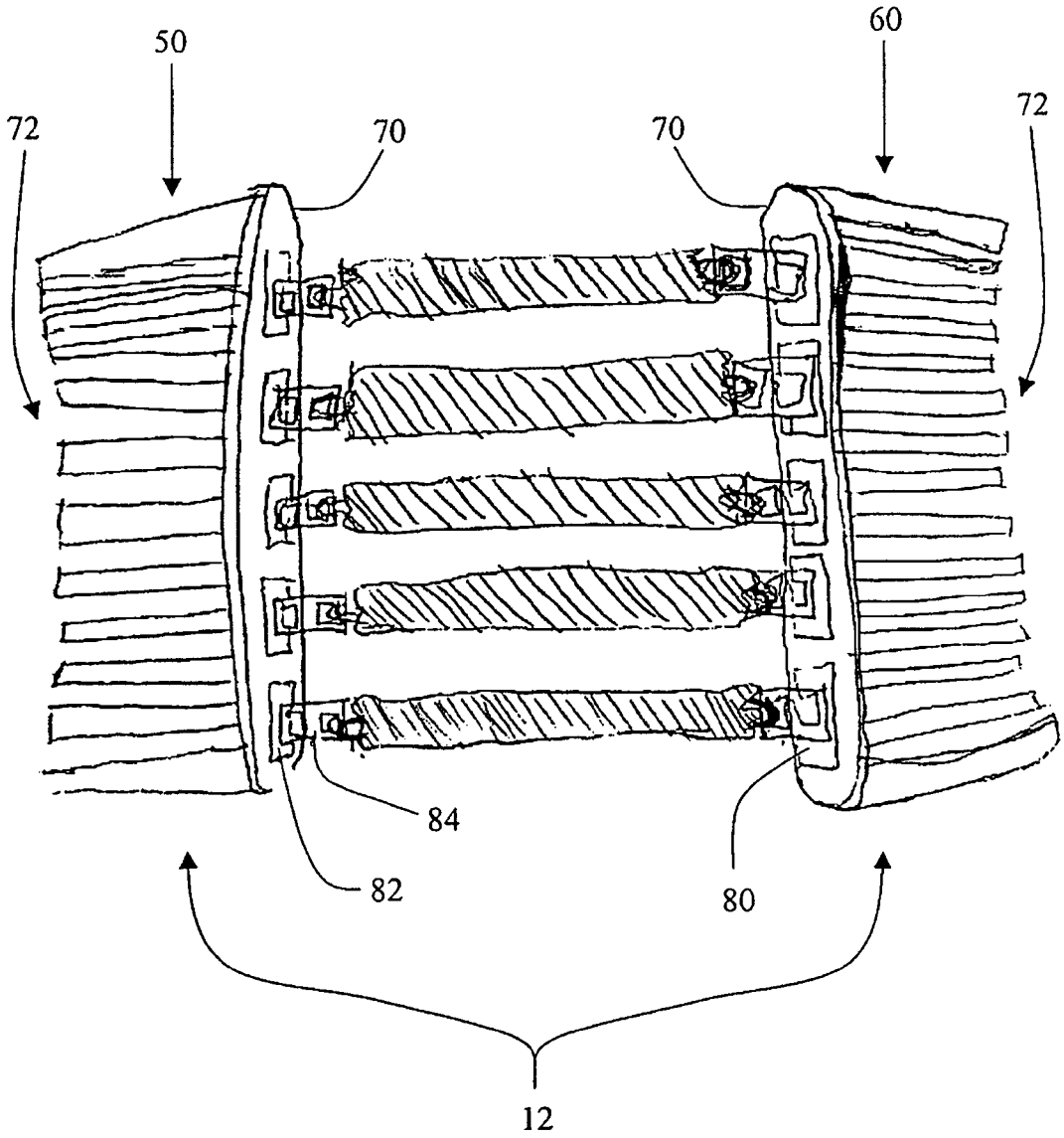
FIG. 4 illustrates the elastic members extending between the combs of the hair accessory shown in FIG. 1, the hair being removed.

FIG. 4 illustrates elastic members 40 extending between combs 12 of hair accessory 10 shown in FIG. 1. In order to better show elastic member 40, hair 14 has been removed. Combs 12 include a first comb 50 and a second comb 60, each having a spine 70 extending the length of first comb 50 and second comb 60. A plurality of teeth 72 extend from spine 70 and a plurality of openings 80 are linearly spaced along spine 70. As shown in FIG. 4, spine 70 includes five such openings 80. In one embodiment, openings 80 are snap-fit receiving slots 82 that extend along spine 70, and are configured to receive comb inserts 84 in a snap-fit arrangement. Alternatively, any other method of attachment of comb inserts 84 to receiving slots 82 may be utilized to attach comb inserts 84 to receiving slots 82.

First comb 50 has a substantially concave-shape along both an axis substantially parallel to spine 70 and an axis substantially parallel to teeth 72. The dual concave-shape facilitates closely aligning combs 50 and 60 of hair accessory 10 to a user's head and hair, therefore, facilitating a more comfortable, more secure attachment to the user.

Figure 5:
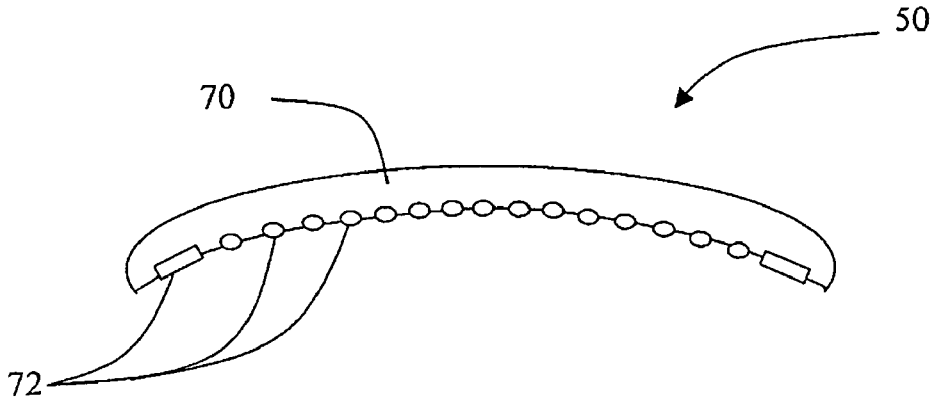
FIG. 5 shows a first side view along a spine of a comb of the hair accessory shown in FIG. 1.
Figure 6:
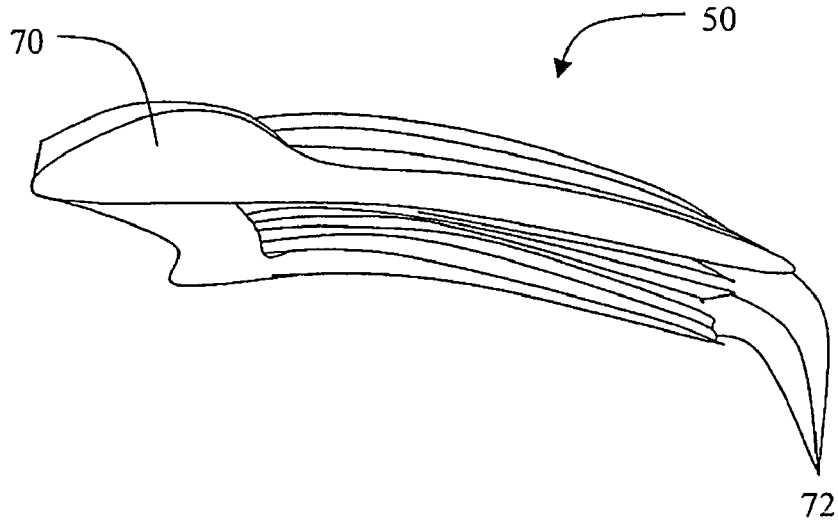
FIG. 6 shows a second side view along a plurality of teeth of the comb of the hair accessory shown in FIG. 1.

FIG. 5 illustrates a first side view of first comb 50 along spine 70 illustrating the concave-shape along spine 70, and FIG. 6 illustrates a second side view of first comb 50 along teeth 72 illustrating the concave-shape along teeth 72. Second comb 60 is substantially identical to first comb 50.

Figure 7:
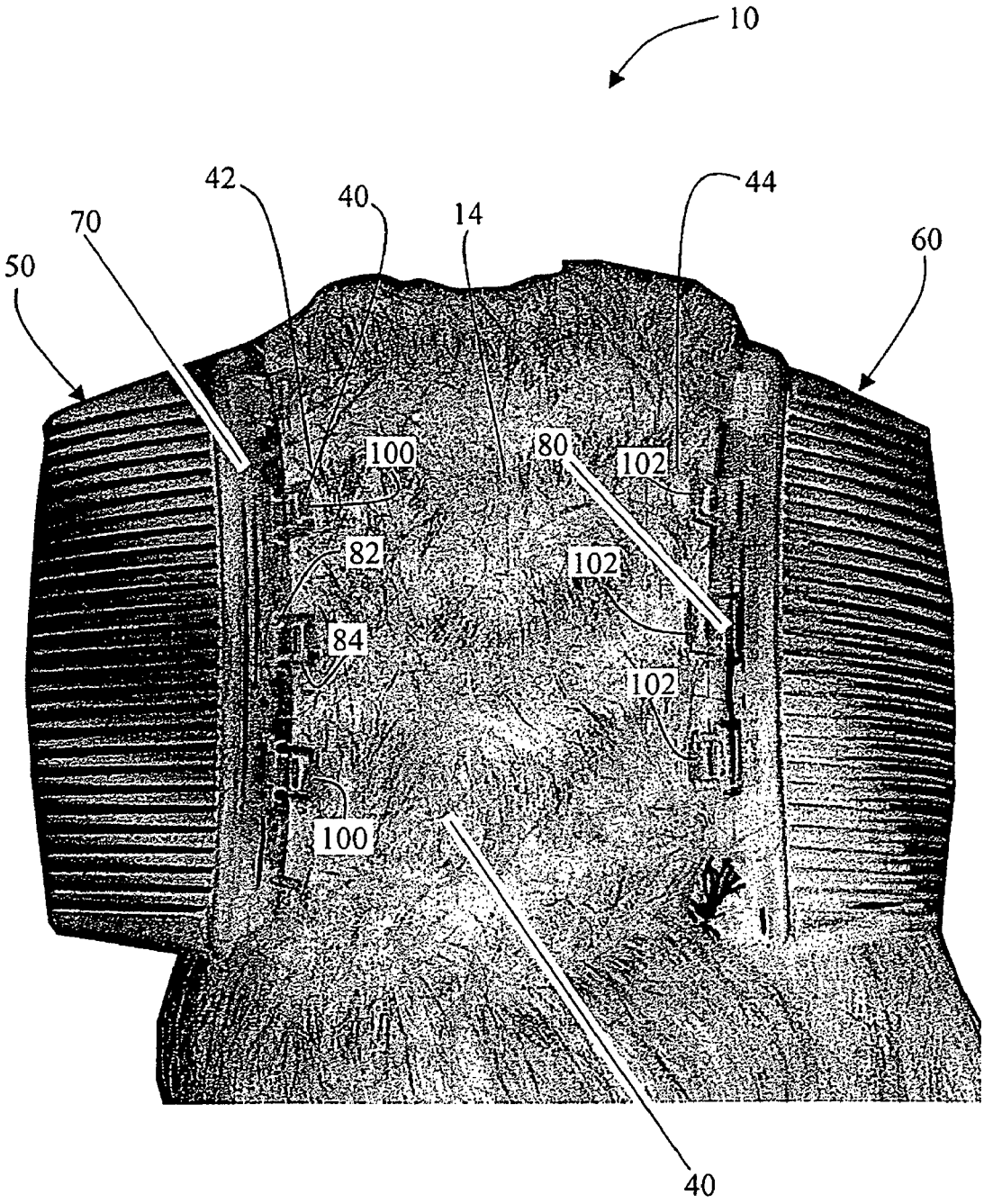
FIG. 7 is a plan view of the hair accessory shown in FIG. 1.

FIG. 7 is a plan view of hair accessory 10 illustrating the relative positioning of first comb 50 to second comb 60 and hair 14, and that openings 80 are aligned when hair accessory 10 is fabricated. Snap-fit receiving slots 82 of first comb 50 are aligned with snap-fit receiving slots 82 of second comb 60. As shown in FIG. 7, first comb 50 is attached to second comb 60 by elastic members 40. First end 42 of each elastic member 40 has a first end loop 100, and second end 44 of elastic members 40 has a second end loop 102. First end loop 100 is utilized to attach first end 42 to comb insert 84 which is configured to engage snap-fit receiving slots 82 of first comb 50. Second end loop 102 is utilized to attach second end 44 to comb insert 84 which is configured to engage snap-fit receiving slots 82 of second comb 60 aligned with snap-fit receiving slots 82 of first comb 50. In an alternative embodiment, first end loop 100 attaches to first comb 50 at openings 80 and second end loop 102 attaches to second comb 60 at openings 80.

In one embodiment, five elastic members 40 are attached between first comb 50 and second comb 60 substantially parallel to each other and substantially perpendicular to first comb 50 and second comb 60. Hair strands 30 of each elastic member 40 are of substantially equal length, and hair strands 30 of a first elastic member 40 overlay hair strands 30 of a second elastic member 40. Also, hair strands 30 substantially cover first comb 50 and second comb 60.

The number of elastic members 40 is equal to the number of aligned openings 80 of first comb 50 and second comb 60. In another embodiment, the user can select the number of elastic members 40 to use, since elastic members 40 are removable. For example, a number of elastic members 40 less than the number of aligned openings 80 allows the supplemental hair to appear shorter in length, and allows the fullness appearance of the supplemental hair to be adjusted according to the user's preferences.

Figure 8:
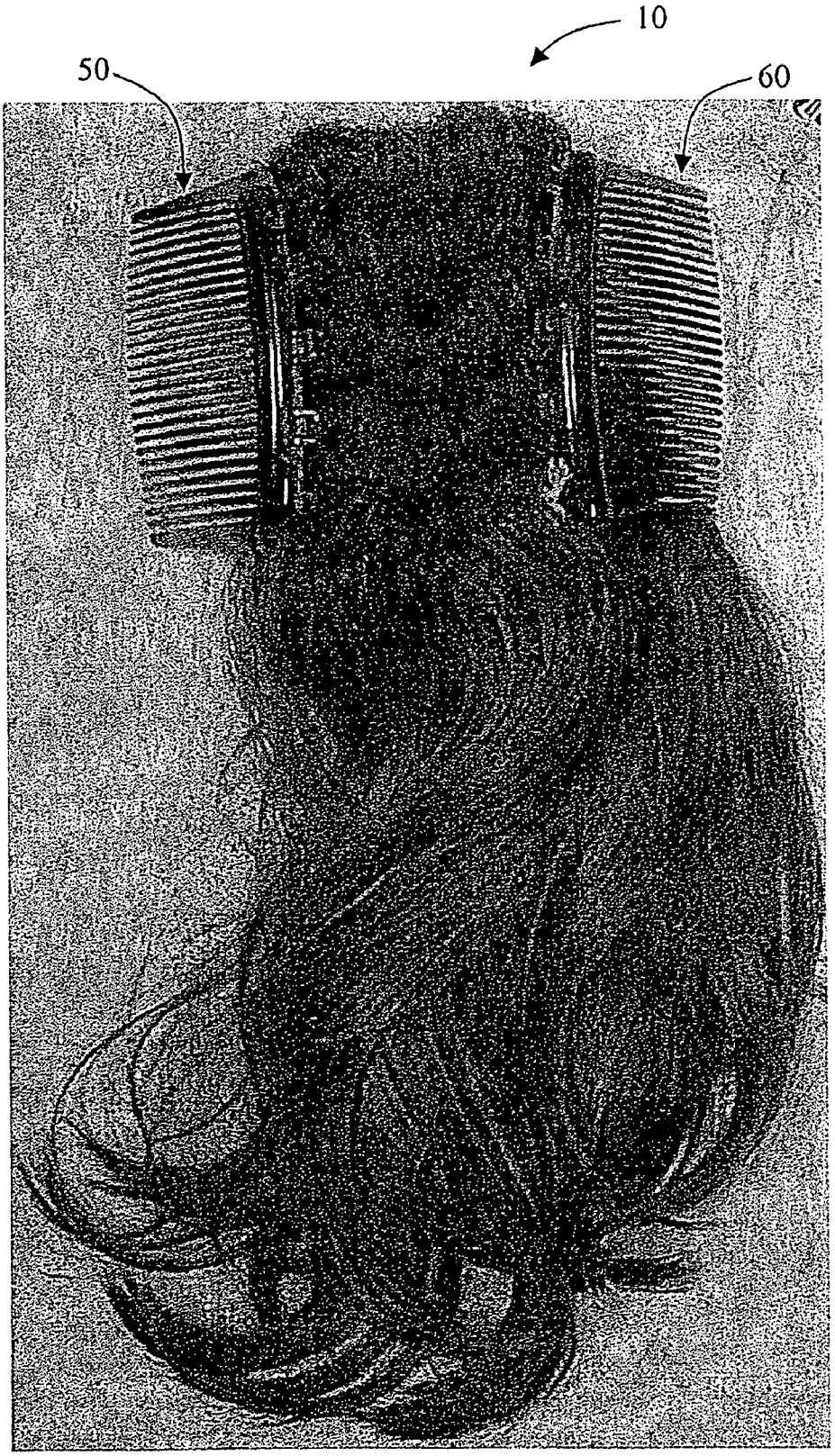
FIG. 8 is a combs open, underside view of the hair accessory shown in FIG. 1.
Figure 9:
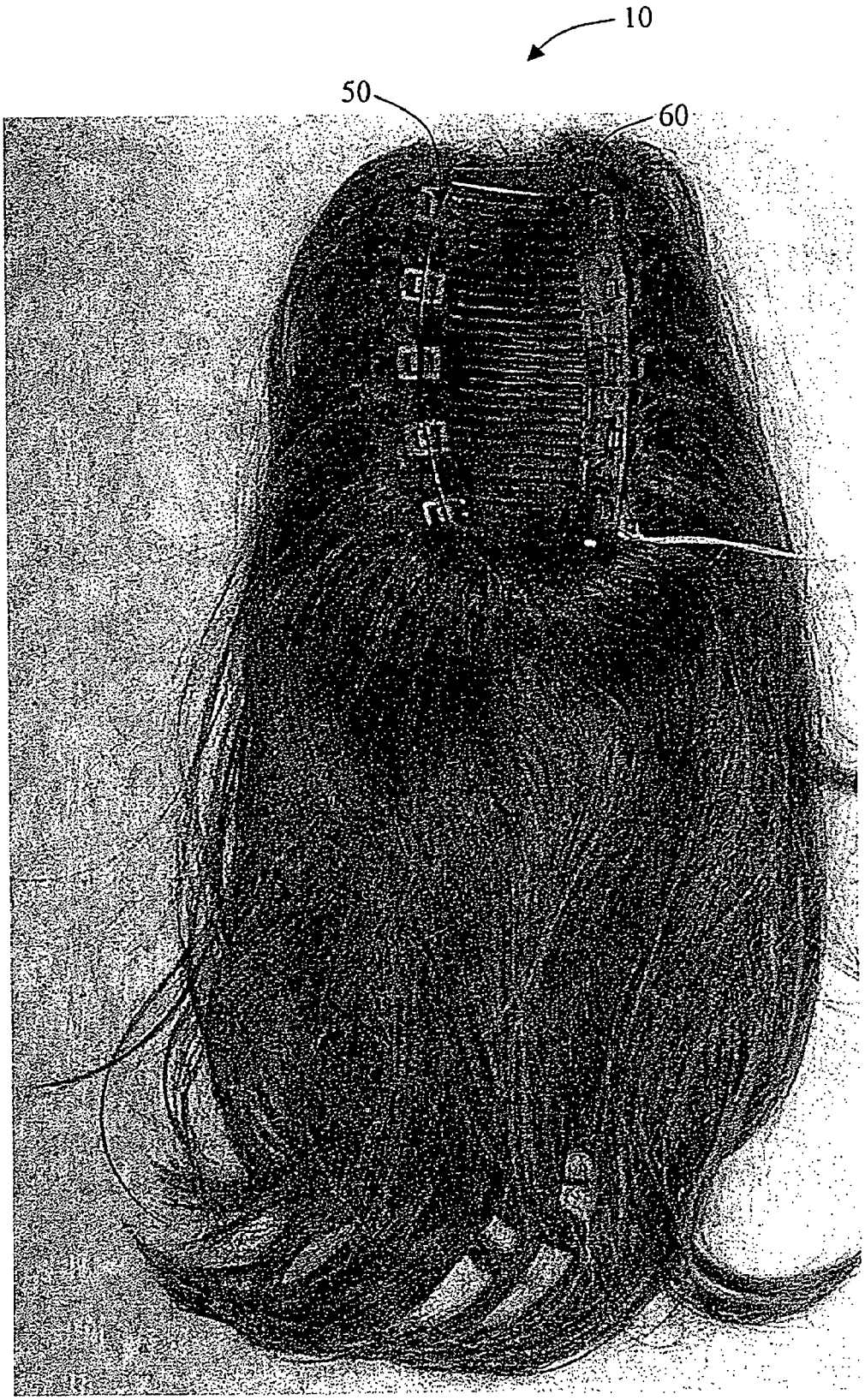
FIG. 9 is a combs closed, underside view of the hair accessory shown in FIG. 1.

FIG. 8 illustrates the underside of hair accessory 10 with first comb 50 and second comb 60 in an open position. FIG. 9 illustrates the underside of hair accessory 10 with first comb 50 and second comb 60 in a closed position. To use hair accessory 10, a user gathers a section of the user's natural hair, inserts first comb 50 into the user's hair from one side of the user's natural hair, and inserts second comb 60 into the user's hair from the opposite side of the user's natural hair underneath first comb 50. The teeth 72 of first comb 50 and second comb 60 facilitate holding hair accessory 10 to the user's natural hair.

Figure 10:
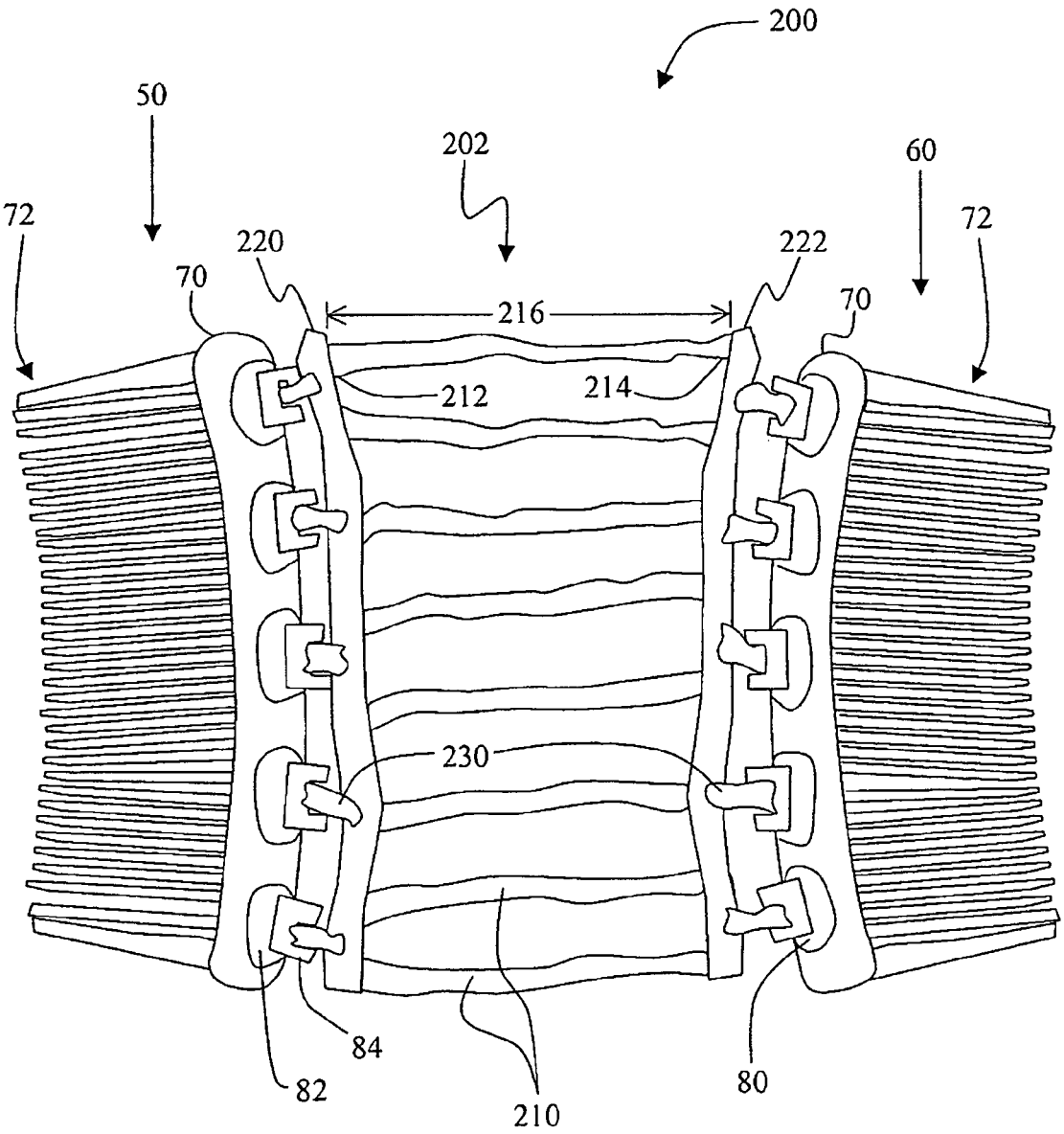
FIG. 10 shows an alternative embodiment of a hair accessory, the hair being removed.

FIG. 10 shows an alternative embodiment of a hair accessory 200, similar to hair accessory 10, having first comb 50 and second comb 60, each having spine 70, plurality of teeth 72, and plurality of openings 80, where openings 80 are snap-fit receiving slots 82 configured to receive comb inserts 84. Combs 50 and 60 are oriented substantially parallel to one another and are connected together by an elastic unit 202 with hair (not shown, for clarity) extending from elastic unit 202.

Elastic unit 202 includes a plurality of lateral elastic strips 210, each having a first end 212, a second end 214 and a length 216 extending between first end 212 and second end 214. Elastic unit 202 includes a first base band 220 and a second base band 222, with elastic strips 210 extending between first base band 220 and second base band 222, with first ends 212 of elastic strips 210 connected to first base band 220, and second ends 214 of elastic strips 210 connected to second base band 222.

In attaching base bands 220 and 222 to combs 50 and 60, base bands 220 and 222 have loops 230 attached along base bands 220 and 222 connecting base bands 220 and 222 to comb inserts 84, which connect to snap-fit receiving slots 82 along spine 70 of combs 50 and 60 as described above. In one embodiment, first base band 220 and second base band 222 have hair bundles (not shown in FIG. 10) attached thereto as further described below with respect to FIG. 11.

Figure 11:
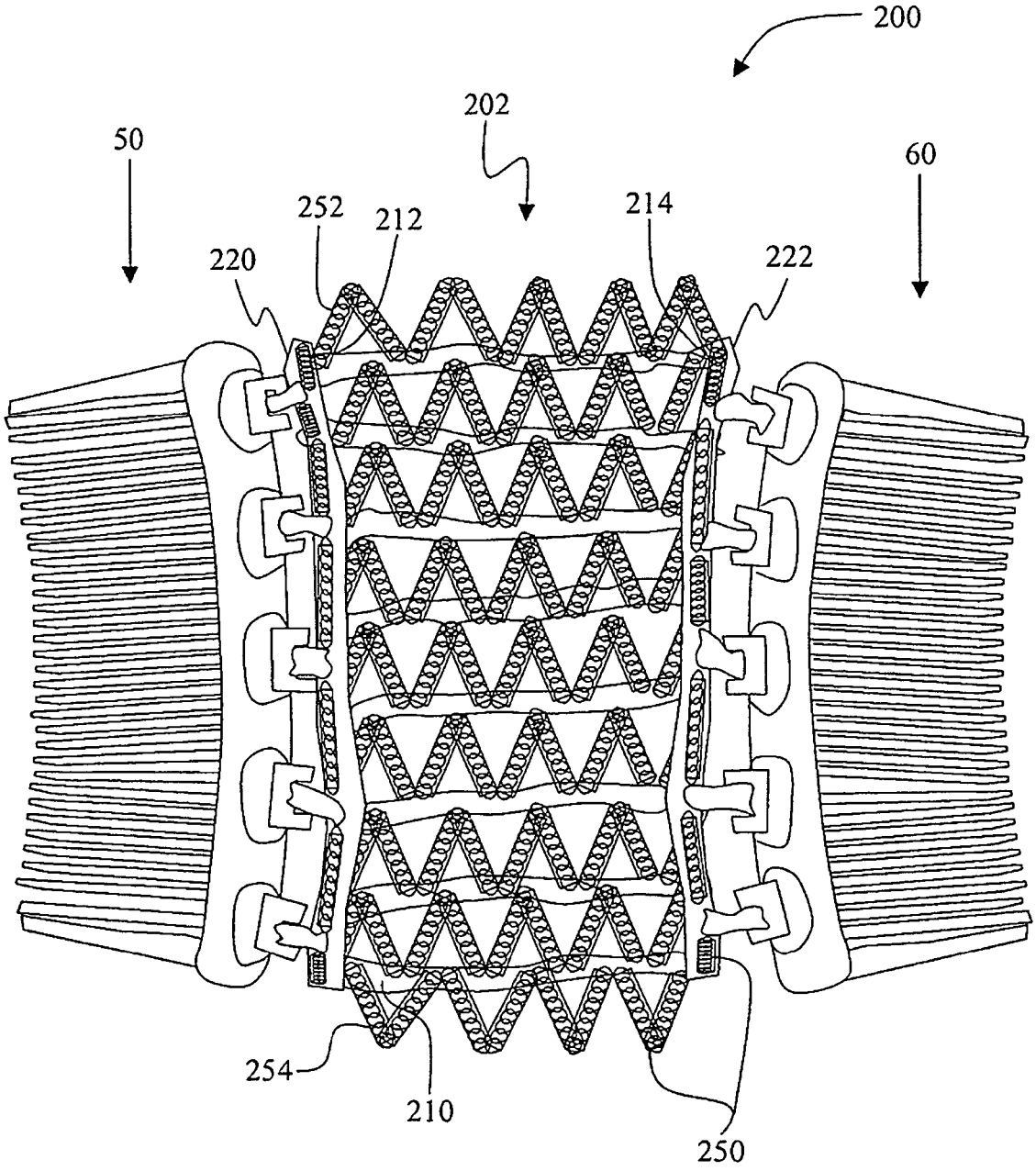
FIG. 11 is a plan view of the alternative hair accessory shown in FIG. 10, illustrating how hair is attached to the accessory.

FIG. 11 is a plan view of hair accessory 200 illustrating the relative positioning and connection of first comb 50, second comb 60, elastic unit 202 (including elastic strips 210), hair attachment members 250, and hair (not shown in FIG. 11 for clarity). Hair strands 30 (shown in FIGS. 2 and 3) or hair bundles 34 (shown in FIG. 2) are bound to hair attachment members 250 through stitching. In an alternative embodiment, hair attachment members 250 form a weft of hair. In one embodiment, a hair attachment member 250 is attached between each adjacent pair of elastic strips 210 in a zig-zag formation, alternating connection between each elastic strip 210 substantially from first end 212 to second end 214. In addition, a hair attachment member 250 may be formed such that it extends from a single elastic strip 210 as illustrated by top hair attachment members 252 and bottom hair attachment members 254. In one embodiment, first base band 220 and second base band 222 are configured as a portion of hair attachment members 250 and have hair strands 30 and/or hair bundles 34 attached thereto, providing a fuller look for hair accessory 200 and further hiding first base band 220 and second base band 222 from the view of others when worn properly.

The user can utilize hair accessories 10 and 200 to supplement the user's natural hair to provide various hair styles, some of which may not be attainable, or desirable in appearance, without hair accessories 10 and 200. While hair accessories 10 and 200 are described as being attachable to the user's natural hair, hair accessories 10 and 200 can also be attached to a wig or other such supplemental hair worn by the user.

Also, while hair accessory 10 is illustrated using a single color of hair for the entire hair accessory, hair accessory 10 can also have differing colors between elastic members, differing colors between support members wrapped around one elastic member, differing colors of hair strands between bundles of hair on one support member, or any combination thereof. Further, while hair accessory 10 is illustrated having hair strands of substantially equal length, hair accessory 10 can have hair strands of differing lengths between elastic members, differing lengths between support members wrapped around one elastic member, differing lengths of hair strands between bundles of hair on one support member, or any combination thereof. Since hair accessory 10 is attachable and detachable, hair accessory 10 may be applied and removed at the leisure of the user.

While the invention has been described in terms of various specific embodiments, those skilled in the art will recognize that the invention can be practiced with modification within the spirit and scope of the claims.

What is claimed is as follows:

1. A hair accessory, comprising:

a first comb;

a second comb;

an elastic unit connecting the first comb and the second comb, the elastic unit comprising:

a first base band operatively coupled to the first comb;

a second base band operatively coupled to the second comb;

a plurality of elastic strips extending between the first base band and the second base band to connect the first base band and the second base band;

a plurality of hair strands coupled to the first base band;

a plurality of hair strands coupled to the second base band;

a plurality of hair attachment members coupled to the plurality of elastic strips; and a plurality of hair strands coupled to the hair attachment members;

wherein at least one respective hair attachment member is coupled to at least two respective elastic strips to form a zig-zag configuration between the first base band and the second base band.

2. The hair accessory of claim 1, wherein the plurality of elastic strips are substantially parallel to one another.

3. The hair accessory of claim 2, wherein the plurality of elastic strips are substantially perpendicular to the first comb and the second comb.

4. The hair accessory of claim 3, wherein:

the hair strands coupled to the first base band comprise at least one of synthetic hair and natural hair, the synthetic hair being fabricated from one or more of a modacrylic polymer fiber and acrylic fiber;

the hair strands coupled to the second base band comprise at least one of synthetic hair and natural hair, the synthetic hair being fabricated from one or more of a modacrylic polymer fiber and acrylic fiber; and the hair strands coupled to the hair attachment members comprise at least one of synthetic hair and natural hair, the synthetic hair being fabricated from one or more of a modacrylic polymer fiber and acrylic fiber.

5. The hair accessory of claim 4, wherein:

the hair strands coupled to the first base band are grouped into hair bundles;

the hair strands coupled to the second base band are grouped into hair bundles; and the hair strands coupled to the hair attachment members are grouped into hair bundles.

6. The hair accessory of claim 1, wherein at least two of the elastic strips are substantially parallel to one another and substantially perpendicular to the first comb and the second comb.

7. The hair accessory of claim 1, wherein:

the hair strands coupled to the first base band comprise at least one of synthetic hair and natural hair, the synthetic hair being fabricated from one or more of a modacrylic polymer fiber and acrylic fiber;

the hair strands coupled to the second base band comprise at least one of synthetic hair and natural hair, the synthetic hair being fabricated from one or more of a modacrylic polymer fiber and acrylic fiber; and the hair strands coupled to the hair attachment members comprise at least one of synthetic hair and natural hair, the synthetic hair being fabricated from one or more of a modacrylic polymer fiber and acrylic fiber.

8. The hair accessory of claim 1, wherein:

the hair strands coupled to the first base band are grouped into hair bundles;

the hair strands coupled to the second base band are grouped into hair bundles; and the hair strands coupled to the hair attachment members are grouped into hair bundles.

9. A hair accessory, comprising:

a first comb;

a second comb;

an elastic unit connecting the first comb and the second comb, the elastic unit comprising:

a first base band operatively coupled to the first comb;

a second base band operatively coupled to the second comb;

a plurality of elastic strips extending between the first base band and the second base band to connect the first base band and the second base band;

a plurality of hair attachment members coupled to the plurality of elastic strips;

a plurality of hair strands coupled to the hair attachment members;

a plurality of hair strands coupled to the first base band and forming a line generally parallel to a line formed by the first base band; and a plurality of hair strands coupled to the second base band and forming a line generally parallel to a line formed by the second base band;

wherein at least one respective hair attachment member is coupled to at least two respective elastic strips to form a zig-zag configuration between the first base band and the second base band.

10. The hair accessory of claim 9, wherein the plurality of elastic strips are substantially parallel to one another.

11. The hair accessory of claim 10, wherein the plurality of elastic strips are substantially perpendicular to the first comb and the second comb.

12. The hair accessory of claim 11, wherein:

the hair strands coupled to the first base band comprise at least one of synthetic hair and natural hair, the synthetic hair being fabricated from one or more of a modacrylic polymer fiber and acrylic fiber;

the hair strands coupled to the second base band comprise at least one of synthetic hair and natural hair, the synthetic hair being fabricated from one or more of a modacrylic polymer fiber and acrylic fiber; and the hair strands coupled to the hair attachment members comprise at least one of synthetic hair and natural hair, the synthetic hair being fabricated from one or more of a modacrylic polymer fiber and acrylic fiber.

13. The hair accessory of claim 12, wherein:

the hair strands coupled to the first base band are grouped into hair bundles;

the hair strands coupled to the second base band are grouped into hair bundles; and the hair strands coupled to the hair attachment members are grouped into hair bundles.

14. The hair accessory of claim 9, wherein at least two of the elastic strips are substantially parallel to one another and substantially perpendicular to the first comb and the second comb.

15. A hair accessory, comprising:

a first comb;

a second comb;

an elastic unit connecting the first comb and the second comb, the elastic unit comprising:

a first base band operatively coupled to the first comb;

a second base band operatively coupled to the second comb;

a plurality of elastic strips extending between the first base band and the second base band to connect the first base band and the second base band;

a plurality of hair attachment members coupled to the plurality of elastic strips;

a plurality of hair strands coupled to the hair attachment members;

a plurality of hair strands coupled to the first base band; and a plurality of hair strands coupled to the second base band;

wherein the first comb includes a first spine and a plurality of teeth extending from the first spine;

wherein the second comb includes a second spine and a plurality of teeth extending from the second spine;

wherein the plurality of hair strands coupled to the first base band are configured to conceal the first spine;

wherein the plurality of hair strands coupled to the second base band are configured to conceal the second spine; and wherein at least one respective hair attachment member is coupled to at least two respective elastic strips to form a zig-zag configuration between the first base band and the second base band.

16. The hair accessory of claim 15, wherein the plurality of elastic strips are substantially parallel to one another.

17. The hair accessory of claim 16, wherein the plurality of elastic strips are substantially perpendicular to the first comb and the second comb.

18. The hair accessory of claim 17, wherein:

the hair strands coupled to the first base band comprise at least one of synthetic hair and natural hair, the synthetic hair being fabricated from one or more of a modacrylic polymer fiber and acrylic fiber;

the hair strands coupled to the second base band comprise at least one of synthetic hair and natural hair, the synthetic hair being fabricated from one or more of a modacrylic polymer fiber and acrylic fiber; and the hair strands coupled to the hair attachment members comprise at least one of synthetic hair and natural hair, the synthetic hair being fabricated from one or more of a modacrylic polymer fiber and acrylic fiber.

19. The hair accessory of claim 18, wherein:

the hair strands coupled to the first base band are grouped into hair bundles;

the hair strands coupled to the second base band are grouped into hair bundles; and the hair strands coupled to the hair attachment members are grouped into hair bundles.

20. The hair accessory of claim 15, wherein at least two of the elastic strips are substantially parallel to one another and substantially perpendicular to the first comb and the second comb.

* * * * *